US011203479B2

(12) United States Patent
Apps et al.

(10) Patent No.: US 11,203,479 B2
(45) **Date of Patent: *Dec. 21, 2021**

(54) COLLAPSIBLE CONTAINER INCLUDING TROUGHS

(71) Applicant: Rehrig Pacific Company, Los Angeles, CA (US)

(72) Inventors: William P. Apps, Alpharetta, GA (US); Jon P. Hassell, Atlanta, GA (US); Travis James Englert, Brea, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/840,804

(22) Filed: Apr. 6, 2020

(65) Prior Publication Data

US 2020/0317421 A1 Oct. 8, 2020

Related U.S. Application Data

(63) Continuation of application No. 16/122,227, filed on Sep. 5, 2018, now Pat. No. 10,611,547.

(Continued)

(51) Int. Cl.
*B65D 81/26* (2006.01)
*B65D 19/06* (2006.01)

(Continued)

(52) U.S. Cl.
CPC ..... *B65D 81/261* (2013.01); *B65D 11/1833* (2013.01); *B65D 19/06* (2013.01);

(Continued)

(58) Field of Classification Search
CPC . B65D 6/16; B65D 7/24; B65D 11/18; B65D 11/1833; B65D 19/06; B65D 21/02;

(Continued)

(56) References Cited

U.S. PATENT DOCUMENTS 2,010,121 A * 8/1935 Fulton ..... B65D 7/24 220/6
4,044,910 A * 8/1977 Box ..... B65D 11/1833 220/7

(Continued)

FOREIGN PATENT DOCUMENTS

DE 2002264 A1 * 9/1970 ..... B65D 19/0018
DE 3718504 A1 * 12/1988 ..... B65D 1/22

(Continued)

*Primary Examiner* — Bryon P Gehman
(74) *Attorney, Agent, or Firm* — Carlson, Gaskey & Olds, P.C.

(57) ABSTRACT

A collapsible container includes a base having a base wall with a plurality of support surfaces separated by a longitudinal drainage channel and a plurality of lateral drainage channels intersecting the longitudinal drainage channel. The drainage channels are lower than the support surfaces. The base wall does not include any openings therethrough, so the drainage channels retain fluid leaking from products or packages in the container. The base may further include a plurality of troughs proximate edges of the base. The plurality of troughs are lower than the drainage channels. Walls are pivotably mounted to the base and are pivotable between an upright position and a collapsed position.

19 Claims, 16 Drawing Sheets

Related U.S. Application Data

(60) Provisional application No. 62/554,558, filed on Sep. 5, 2017.

(51) Int. Cl.
*B65D 6/18* (2006.01)
*B65D 21/02* (2006.01)

(52) U.S. Cl.
CPC .... *B65D 21/0235* (2013.01); *B65D 2519/008* (2013.01); *B65D 2519/00925* (2013.01)

(58) Field of Classification Search
CPC .... B65D 21/0235; B65D 21/04; B65D 81/26; B65D 81/261; B65D 2519/008; B65D 2519/009; B65D 2519/00925; B65D 25/04; B65D 25/28; B65D 43/02; B65D 85/00
USPC ..... 206/386, 600; 220/6, 7
See application file for complete search history.

(56) References Cited

U.S. PATENT DOCUMENTS

| | | | | |
|---|---|---|---|---|
| 6,601,724 | B1 * | 8/2003 | Koefelda | B65D 11/1833 220/4.28 |
| 8,672,132 | B2 * | 3/2014 | Ramirez | B65D 1/36 206/521.1 |
| 8,770,421 | B2 * | 7/2014 | Hay | B65F 1/02 220/4.28 |
| 8,807,365 | B2 * | 8/2014 | Orgeldinger | B65D 11/1833 220/6 |
| 9,394,077 | B2 * | 7/2016 | Weyrauch | B65D 19/06 |
| 2018/0057205 | A1 * | 3/2018 | Ramos | B65D 21/0212 |

FOREIGN PATENT DOCUMENTS

| | | | | |
|---|---|---|---|---|
| GB | 1202142 | A * | 8/1970 | B65D 81/261 |
| GB | 2266294 | A * | 10/1993 | B65D 81/262 |
| WO | WO-9607603 | A1 * | 3/1996 | B65D 81/261 |

* cited by examiner

COLLAPSIBLE CONTAINER INCLUDING TROUGHS

BACKGROUND

Collapsible containers often include a base, opposed side walls, and opposed end walls. The side walls and end walls are hingeably connected to the base. The side walls and end walls can be pivoted between an upright position, where each wall is latched to an adjacent wall, and a collapsed position on the base. In the collapsed position, the container occupies less volume for efficient storage and shipping when empty. The base, side walls and end walls typically contain many openings that provide ventilation during refrigeration and drainage during washing.

Sometimes collapsible containers are used for meat and poultry packages for grocery stores. The fluids that may leak from packages during transit that can promote food borne illnesses.

SUMMARY

A collapsible container includes a base having a plurality of support surfaces separated by a longitudinal drainage channel and a plurality of lateral drainage channels intersecting the longitudinal drainage channel. The drainage channels are lower than the support surfaces. The base does not include any openings therethrough, so the drainage channels retain fluid leaking from products or packages supported on the support surfaces in the container. The base may further include a plurality of troughs proximate edges of the base. The troughs are lower than the drainage channels and further retain any fluid in the base of the container. Walls are pivotably mounted to the base and are pivotable between an upright position and a collapsed position. The base interior does not include any hard edges or ribs in order to protect the packages and prevent causing the packages to leak.

DETAILED DESCRIPTION

Figure 1:
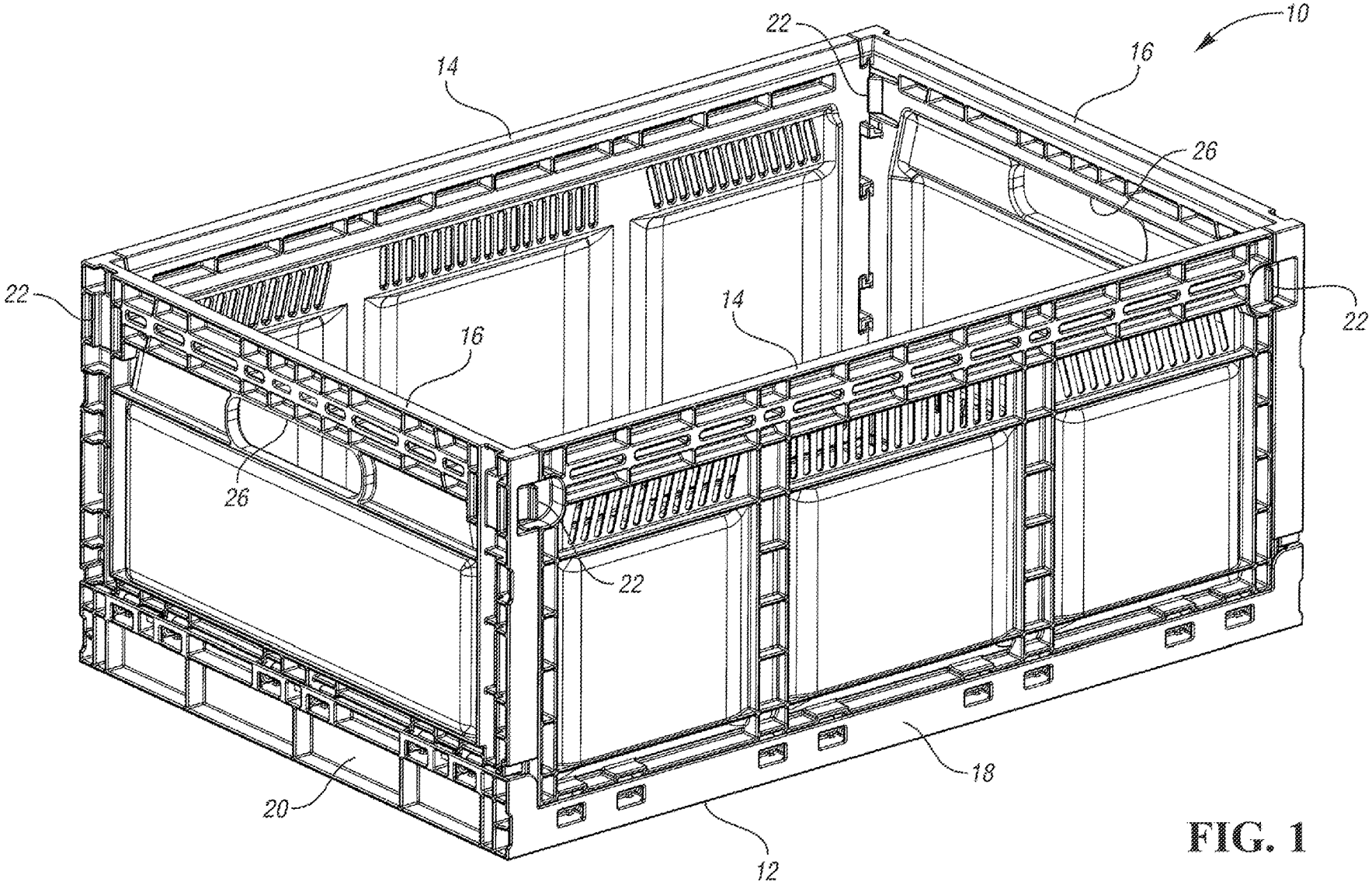
FIG. 1 is a perspective view of a collapsible container according to one embodiment.

An example embodiment of a collapsible container 10 is shown in FIG. 1. The container 10 includes a base 12, opposed side walls 14 and opposed end walls 16. The base 12 includes a base wall and side flanges 18 and end flanges 20 extending upward from side edges and end edges of the base wall, respectively. The side walls 14 are hingeably connected to the side flanges 18. The end walls 16 are hingeably connected to the end flanges 20. The end flanges 20 are taller than the side flanges 18. End flanges 20 and side flanges 18 are integrally molded as part of the base 12. Latches 22 selectively secure the side walls 14 to the end walls 16 in a known manner. Handle openings 26 may be formed in the end walls 16.

Figure 2A:
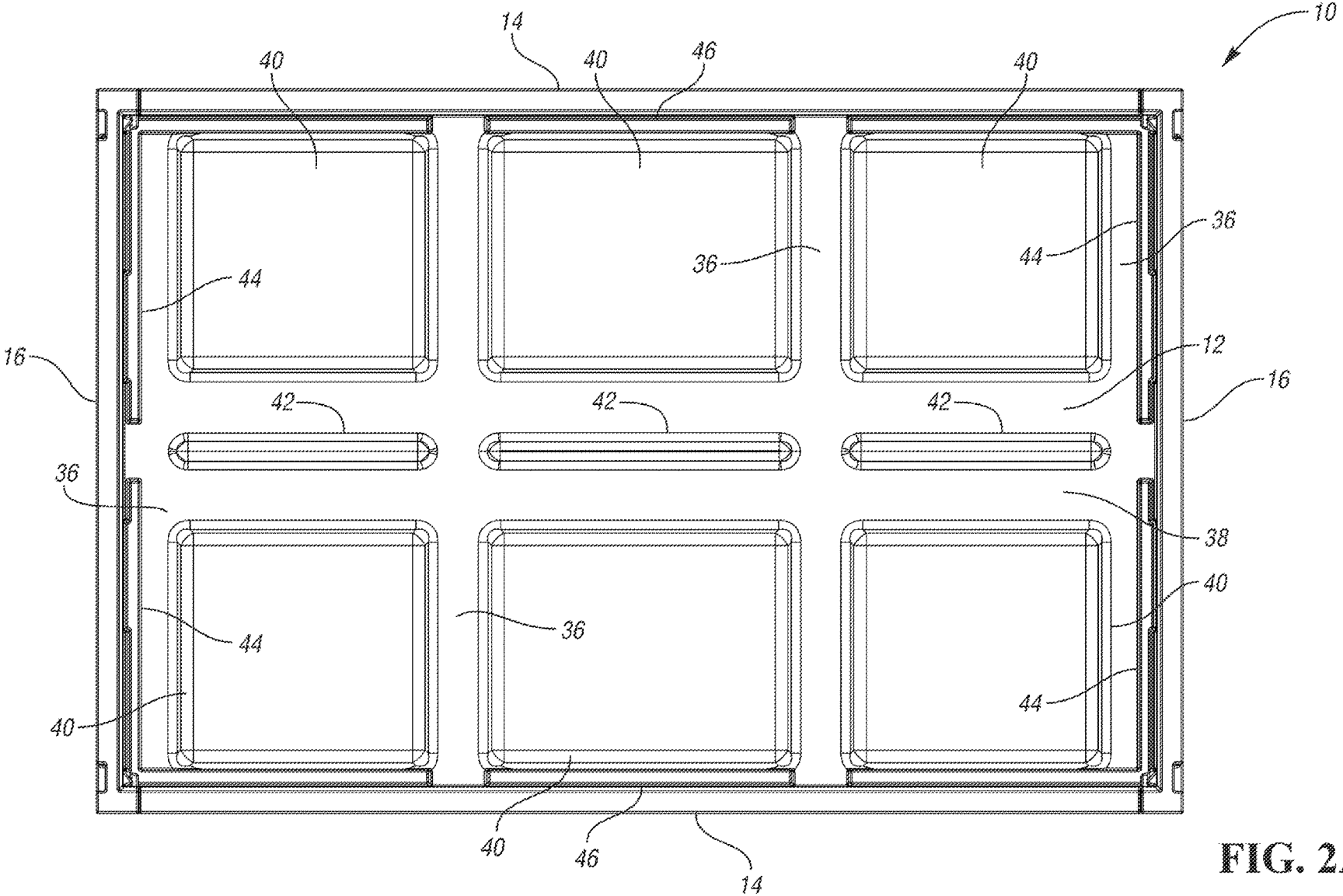
FIG. 2A is a top view of the container of FIG. 1.
Figure 2B:
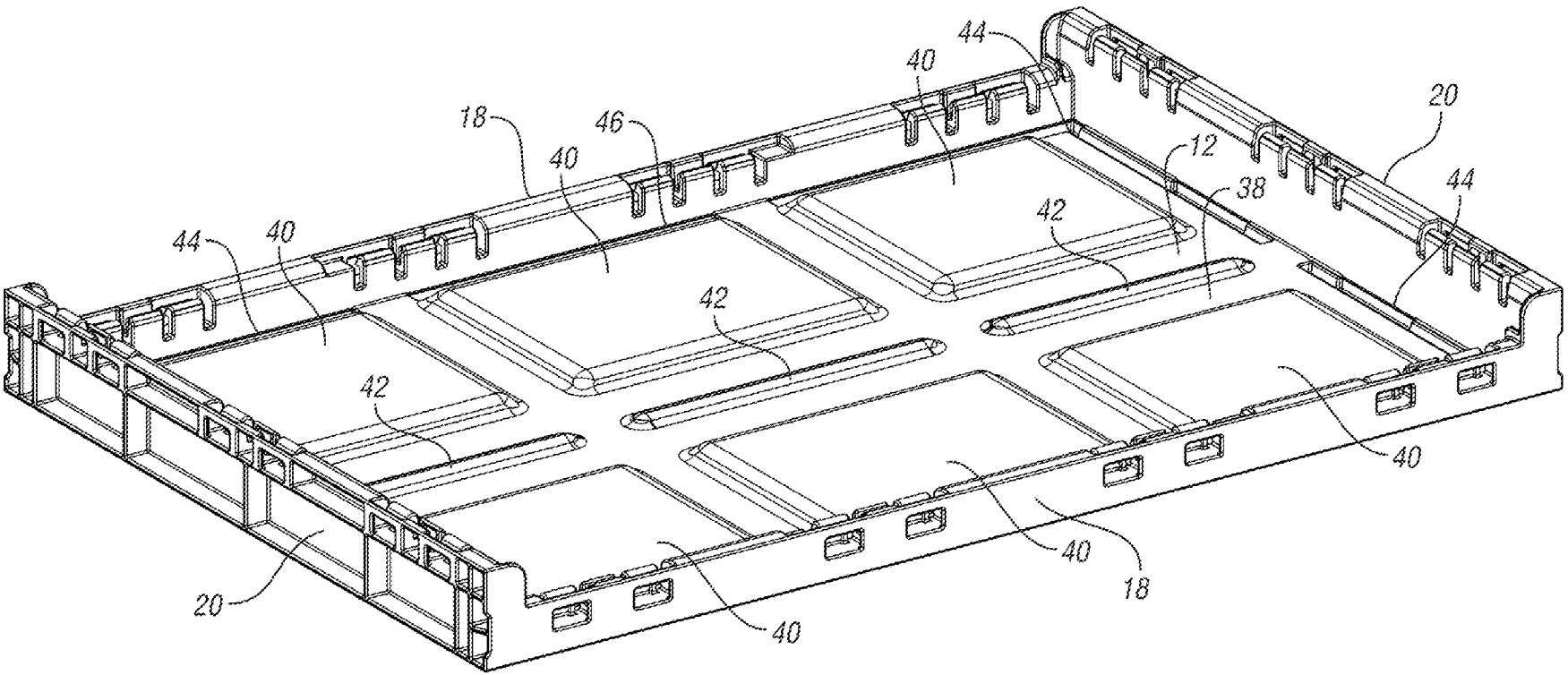
FIG. 2B is an upper perspective view of the base of the container of FIG. 1.

FIG. 2A is a top view of the container 10. FIG. 2B is a perspective view of the base 12. Referring to FIGS. 2A and 2B, the base wall of the base 12 is a generally planar portion formed into a grid of a longitudinal drainage channel 38 and intersecting lateral drainage channels 36, thereby forming a 3×2 array of pair of spaced support surfaces 40. The support surfaces 40 may optionally be pitched slightly toward the drainage channels 36 and/38 that are lower than the support surfaces 40. The longitudinal drainage channel 38 extends the length of the base 12 and separates the support surfaces 40 into two 3×1 arrays.

A plurality of ridges 42 protrude upward from the longitudinal drainage channel 38. The ridges 42 are elongated in a direction generally parallel to the long axis of the base 12. The ridges 42 add stiffness to the base 12, while still allowing the upper, thicker portions of the side walls 14 to be received in the longitudinal drainage channel 38 when collapsed. An L-shaped trough 44 is formed in each corner of the base 12. A side trough 46 is formed along the center of each side edge of the base 12 between the L-shaped troughs 44. The troughs 44, 46 are the lowest portions of the base 12 (and form the drag rails on the lower surface of the base 12). Thus any liquids that may leak from contents in the container 10 will drain from the support surfaces 40 toward the longitudinal drainage channel 38 and then toward the troughs 44, 46. This initially keeps the liquids from the support surfaces 40 and ridges 42 on which the contents of the container 10 are supported. The base wall of the base 12 does not include openings through it and thus will retain liquids in the base 12 until hinge openings through the flanges 18, 20 are reached. Optionally, slots can be added in the end flanges 20 or side flanges 18 of the base 12 at a specific height in order to control the volume of fluid capacity. The slots may be at the same height of the hinge openings, or they may be lower, depending on the desired volume to be retained. The slots will also help with drainage during the washing and drying process.

Referring to FIG. 2B, the interior surface of the bottom of the base wall is product-friendly, with no sharp edges or protruding ribs throughout the entire bottom section of the base 12. As such, the bottom of the base 12 was designed with smooth drainage channels 36, 38 and raised support surfaces 40 to create a stiff design without the use of ribs or sharp edges. This soft bottom profile ensures that poultry packages do not get ripped, torn, or damaged when placed inside the container.

Figure 2C:
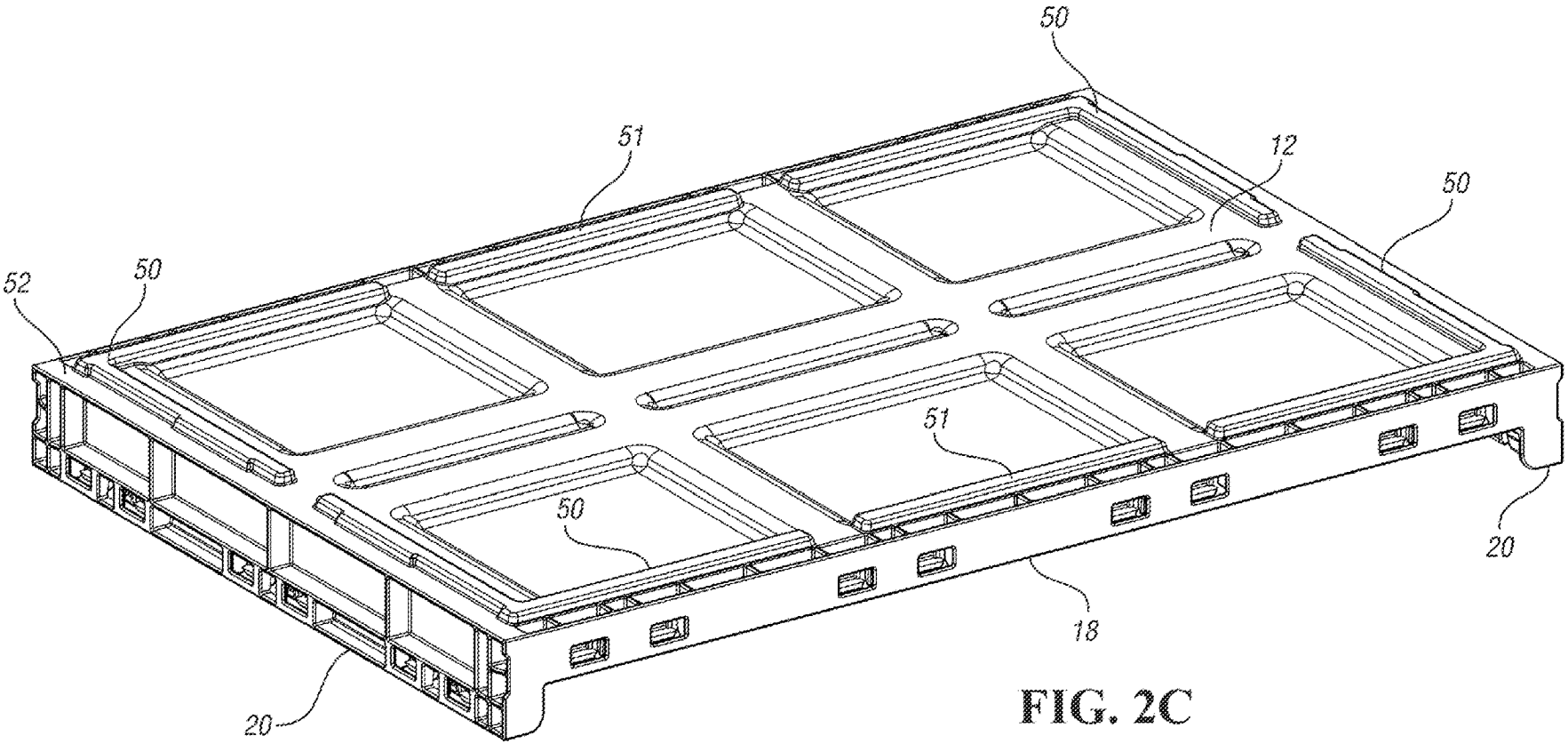
FIG. 2C is a lower perspective view of the base of FIG. 2B.
Figure 3:
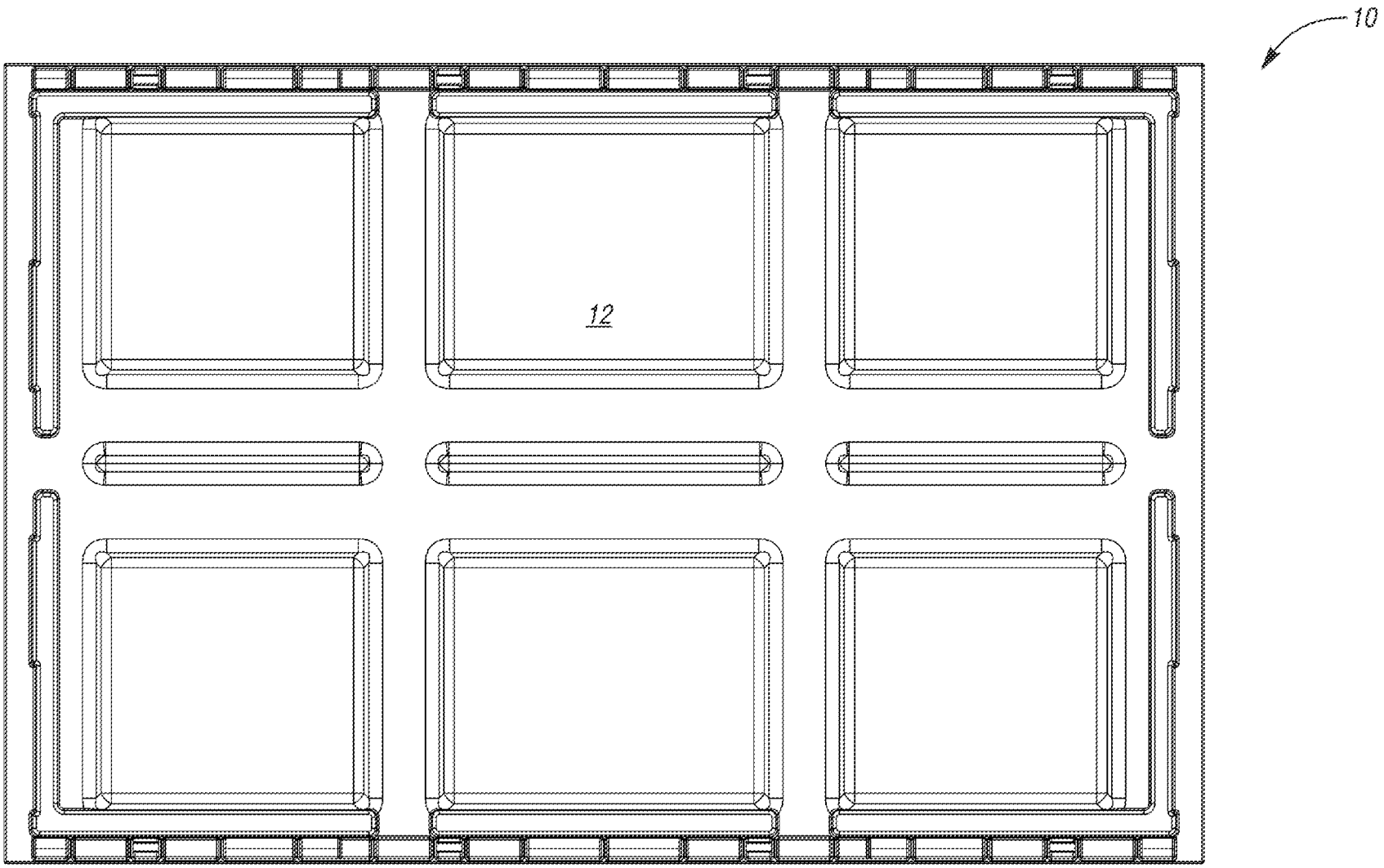
FIG. 3 is a bottom view of the container of FIG. 1.

FIG. 2C is a bottom perspective view of the base 12. The exterior surface of the bottom of the base 12 is product-friendly, with no sharp edges or protruding ribs throughout the entire bottom section of the base 12. As such, the bottom of the base 12 was designed with smooth drainage channels 36, 38 and raised support surfaces 40 to create a stiff design without the use of ribs or sharp edges. This soft bottom profile ensures that poultry packages in one container do not get ripped, torn, or damaged when another container is stacked on top. A drag rail is formed about most of the periphery of the base 12 but is spaced inward of the periphery of the base 12 to leave a peripheral support surface 52. The drag rail includes corner drag rails 50, formed by the L-shaped troughs 44 (FIG. 2B), and the drag rail includes side drag rails 51, formed by the side troughs 46 (FIG. 2B). The drag rail provides the lowermost surfaces of the container 10. FIG. 3 is a bottom view of the base 12.

Figure 4:
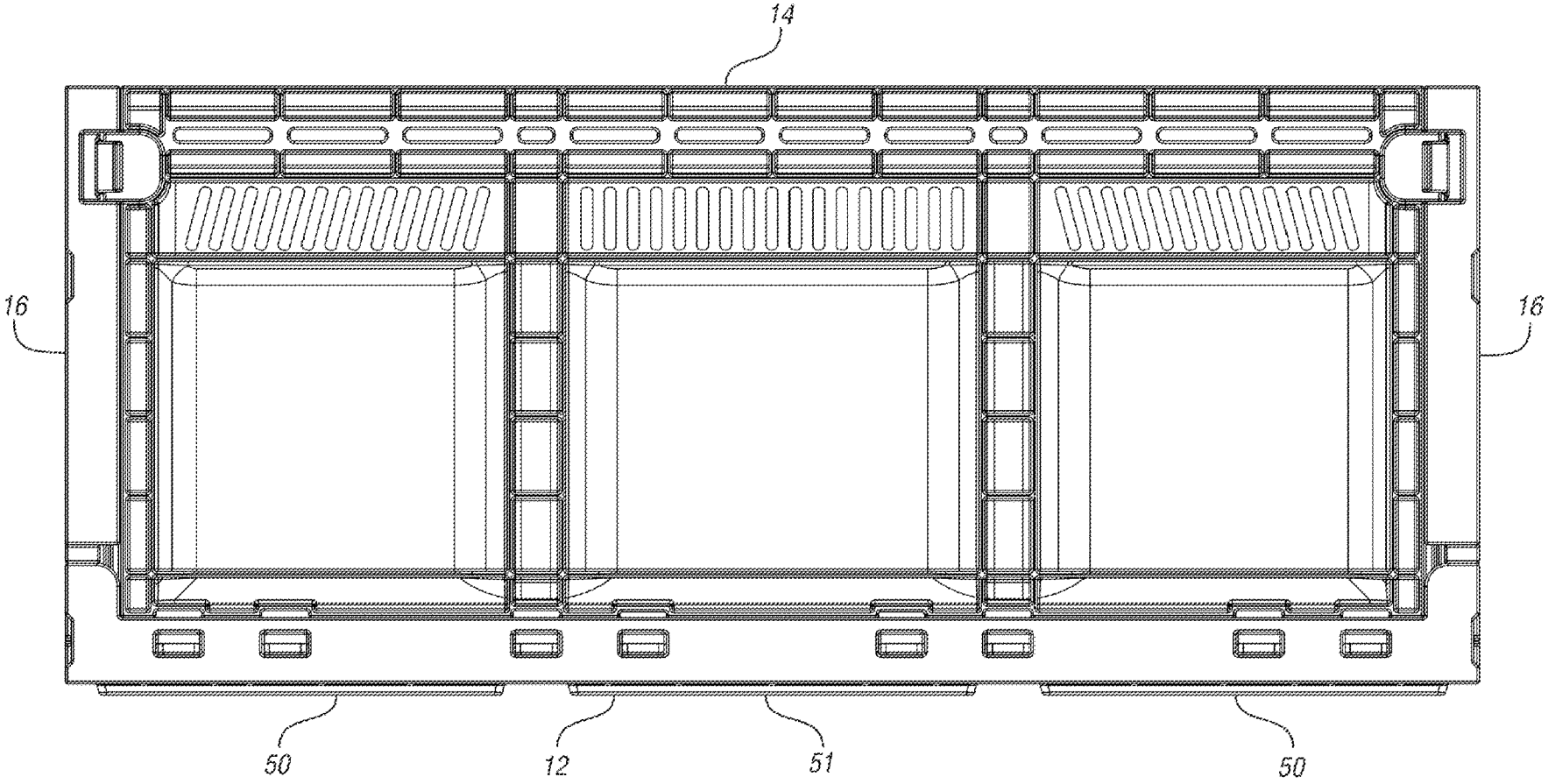
FIG. 4 is a side view of the container of FIG. 1.
Figure 5:
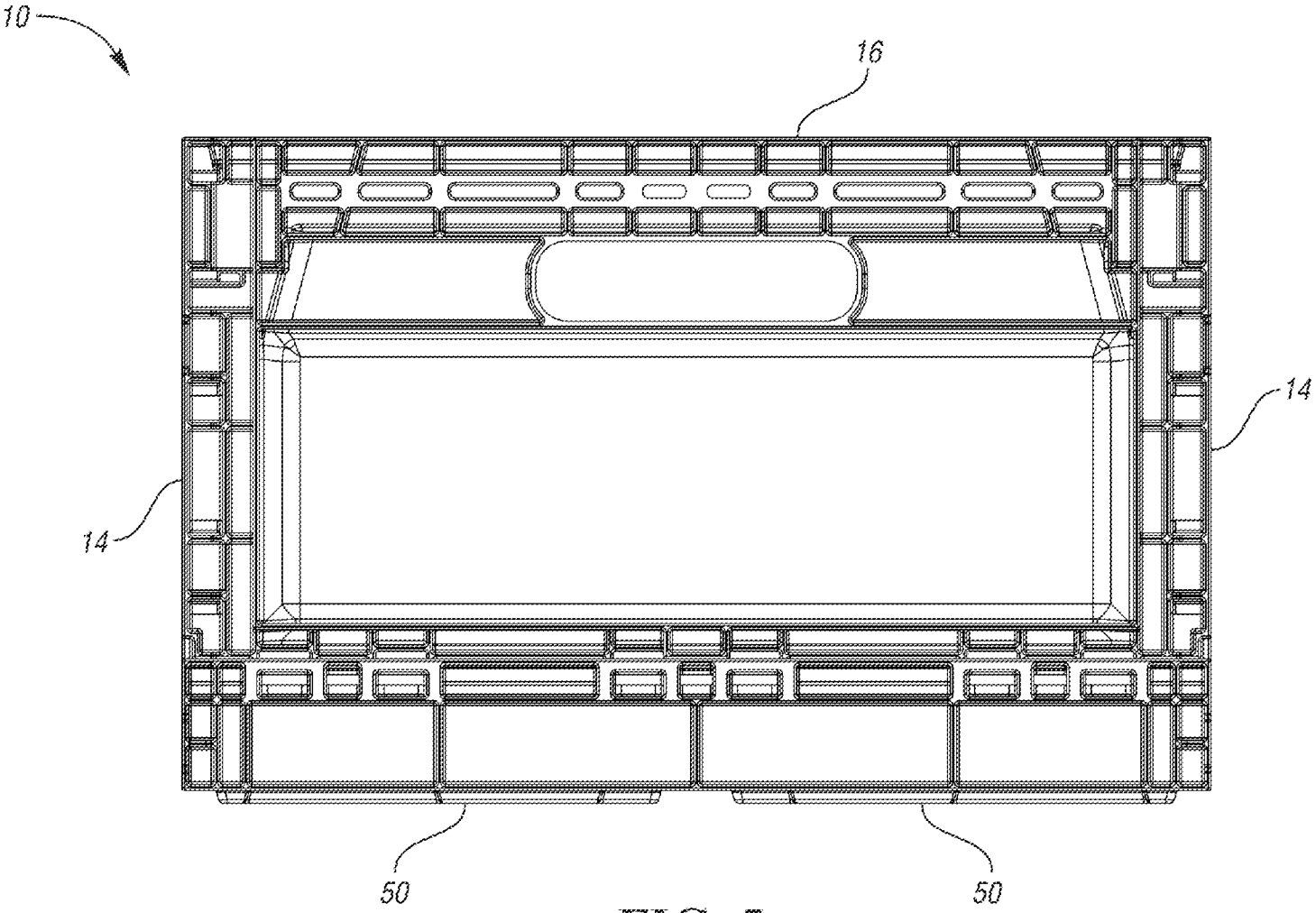
FIG. 5 is an end view of the container of FIG. 1.

FIG. 4 is a side view of the container 10. FIG. 5 is an end view of the container 10. As shown in FIGS. 4 and 5, the corner drag rails 50 and the side drag rails 51 provide the lowermost surfaces of the container 10.

Figure 6B:
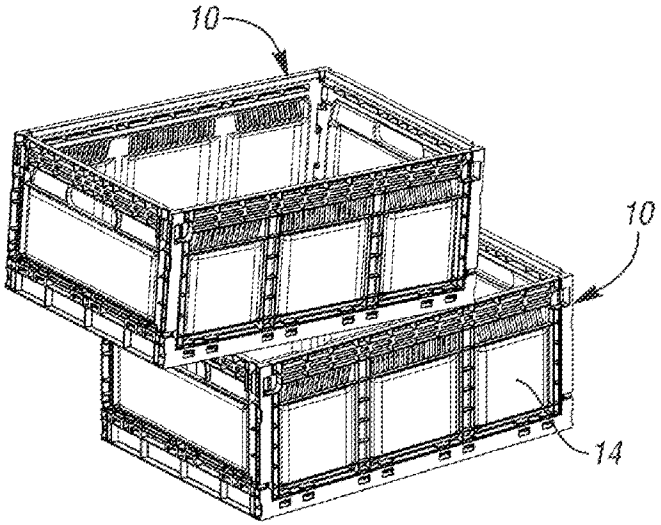
FIG. 6B shows the containers of FIG. 6A in a second step of slide stacking the containers.
Figure 6D:
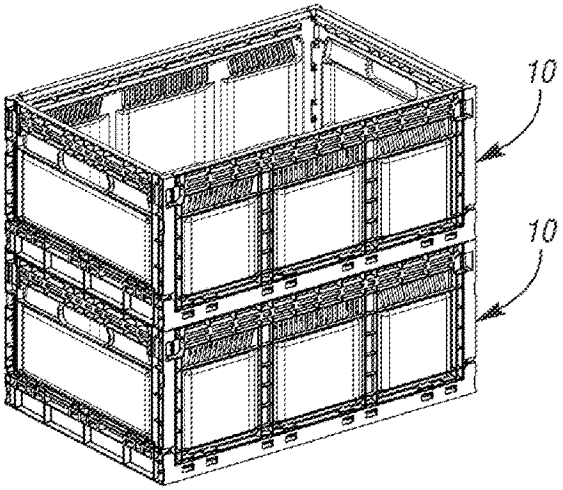
FIG. 6D shows the containers of FIG. 6A stacked.
Figure 6A:
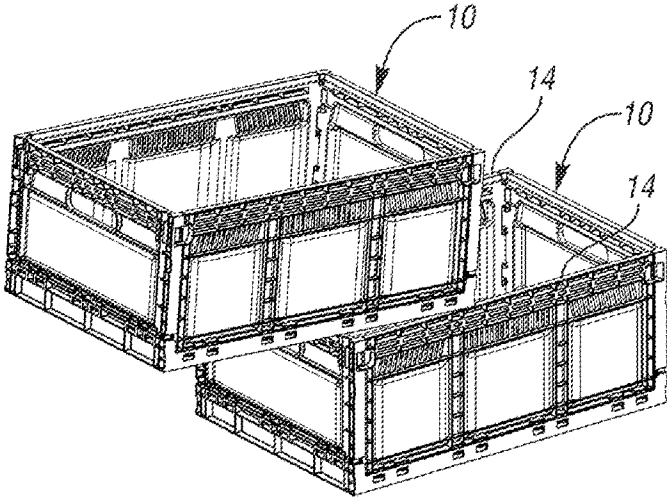
FIG. 6A shows the container of FIG. 1 in a first step of slide stacking the container onto an identical container.
Figure 6C:
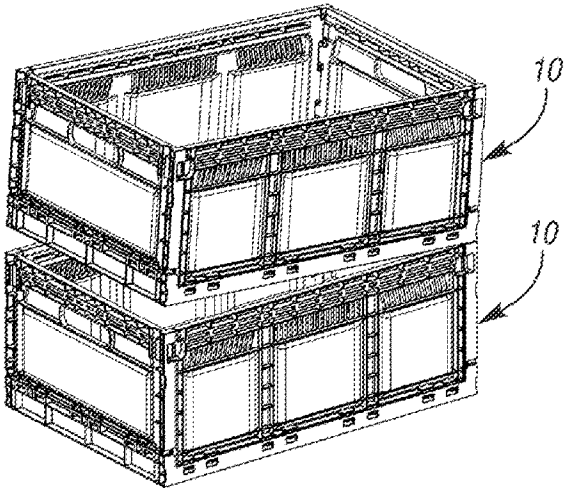
FIG. 6C shows the containers of FIG. 6A in a third step of slide stacking the containers.

FIGS. 6A-D show two of the containers 10 being slide-stacked. In FIG. 6A, one end of the upper container 10 is placed on the middle of the side walls 14 of the lower container 10. The upper container 10 is then slid toward the opposite end of the lower container 10 as shown in FIGS. 6B and 6C. The other end of the upper container 10 is then lowered onto the lower container 10 in FIG. 6D, which shows the two containers 10 column-stacked.

Figure 7:
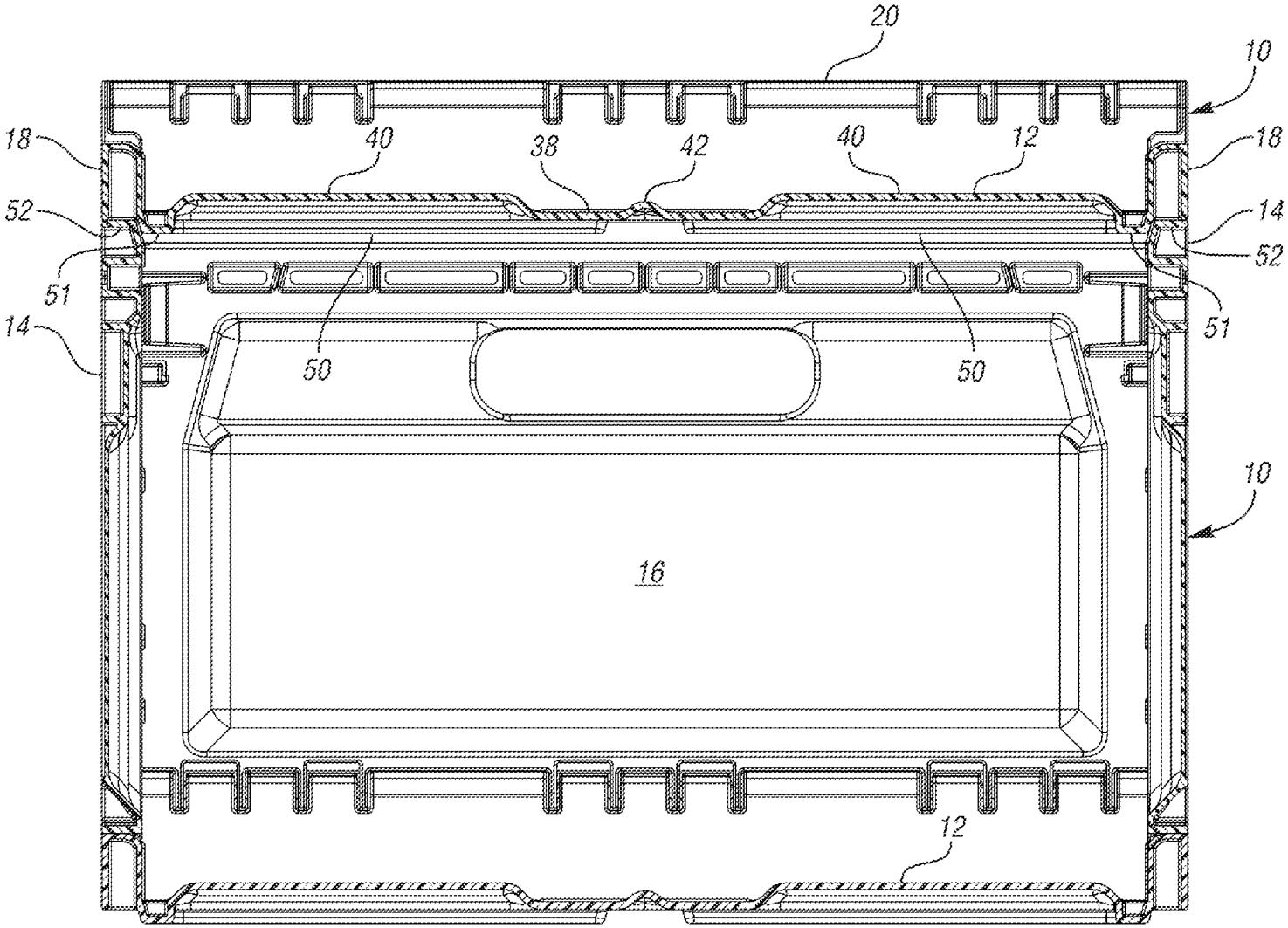
FIG. 7 is a section view through the stacked containers of FIG. 6D.

FIG. 7 is a section view through the containers 10 of FIG. 6D, taken along a plane parallel to the end walls 16. As shown, the side drag rails 51 abut inner surfaces of the side walls 14 with the peripheral support surface 52 supported directly on the side walls 14 of the lower container 10. The corner drag rails 50 are received just inside the side walls 14 and end walls 16 of the lower container 10.

Figure 8:
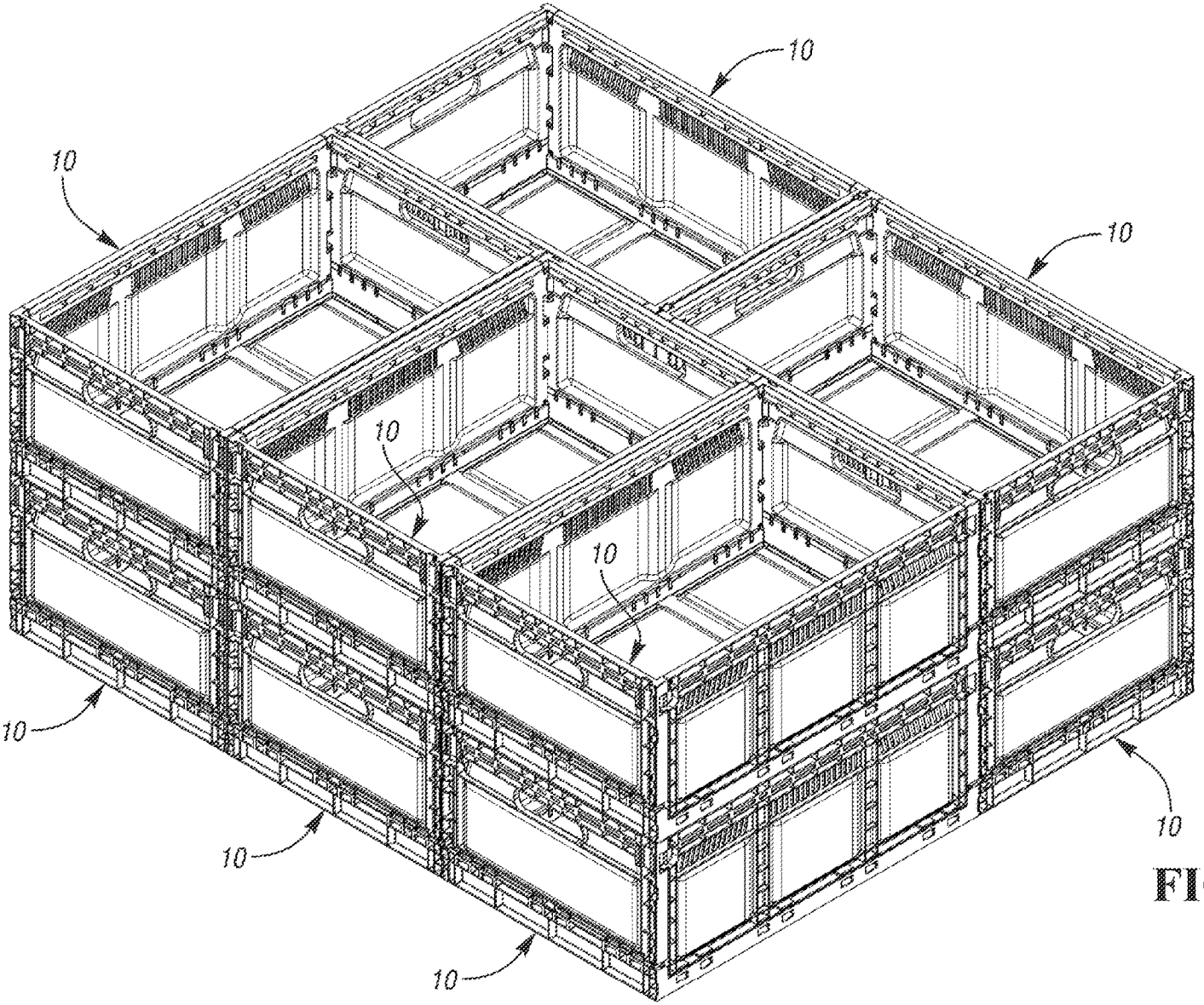
FIG. 8 shows a plurality of the containers of FIG. 1 column-stacked.

FIG. 8 shows a plurality of column-stacked containers 10, showing how five columns of containers 10 would fit on a standard pallet.

Figure 9:
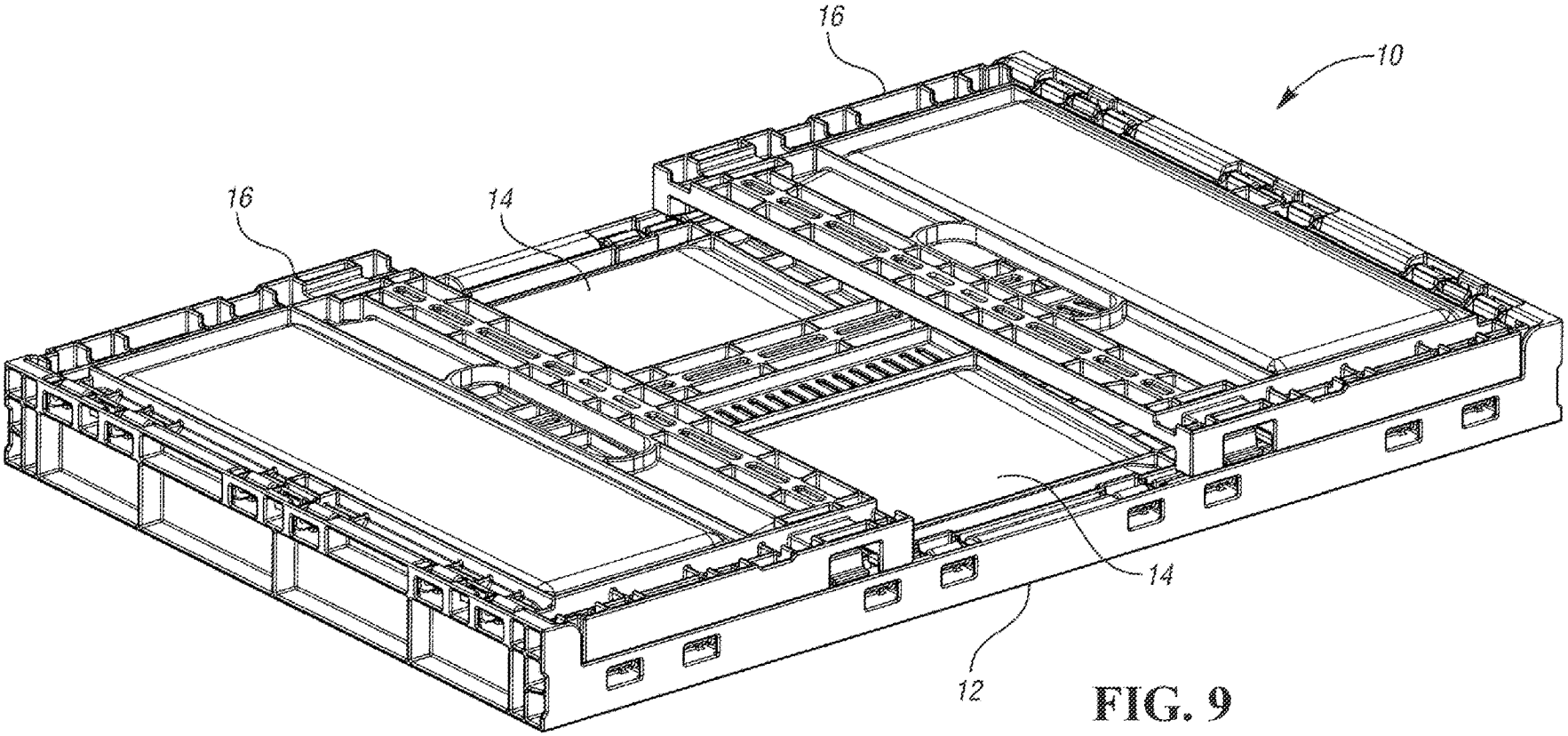
FIG. 9 shows the container of FIG. 1 collapsed.

As shown in FIG. 9, the container 10 is collapsible. As is known, after releasing the latches 22 (FIG. 1), the side walls 14 can be collapsed onto the base 12 (with one side wall 14 partially on top of the other) and the end walls 16 can then be collapsed onto the side walls 14 and the base 12. The collapsed container 10 can then be shipped and stored efficiently when empty.

Figure 10:
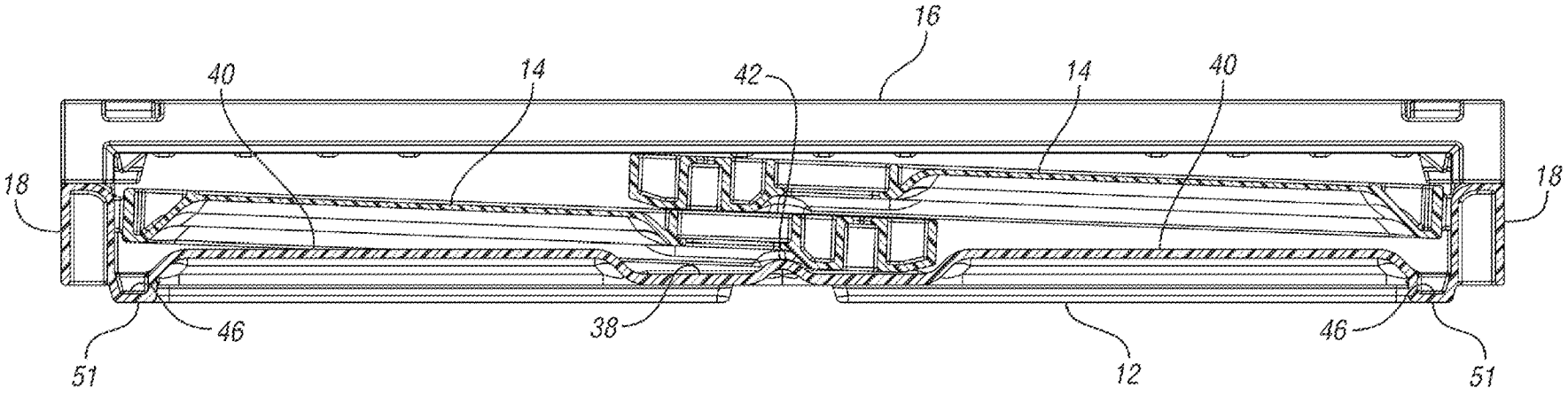
FIG. 10 is a section view through the collapsed container of FIG. 9.

FIG. 10 is a section view through the collapsed container 10 of FIG. 9, taken along a plane perpendicular to the side walls 14. As shown, the longitudinal drainage channel 38 is lower than the support surfaces 40, but the troughs 46 are lower than the longitudinal drainage channel 38. The troughs 46 form the drag rails 51 (and troughs 44 form the drag rails 50, not shown). When collapsed, the upper, thicker portions of one of the side walls 14 (whichever one is folded down first) are received in the longitudinal drainage channel 38, which is lower than the support surfaces 40. This reduces the overall height of the container 10 when collapsed. The other side wall 14 is folded partially over the first side wall 14 (either one can be folded down first). The end walls 16 are then folded down over the side walls 14.

Figure 11:
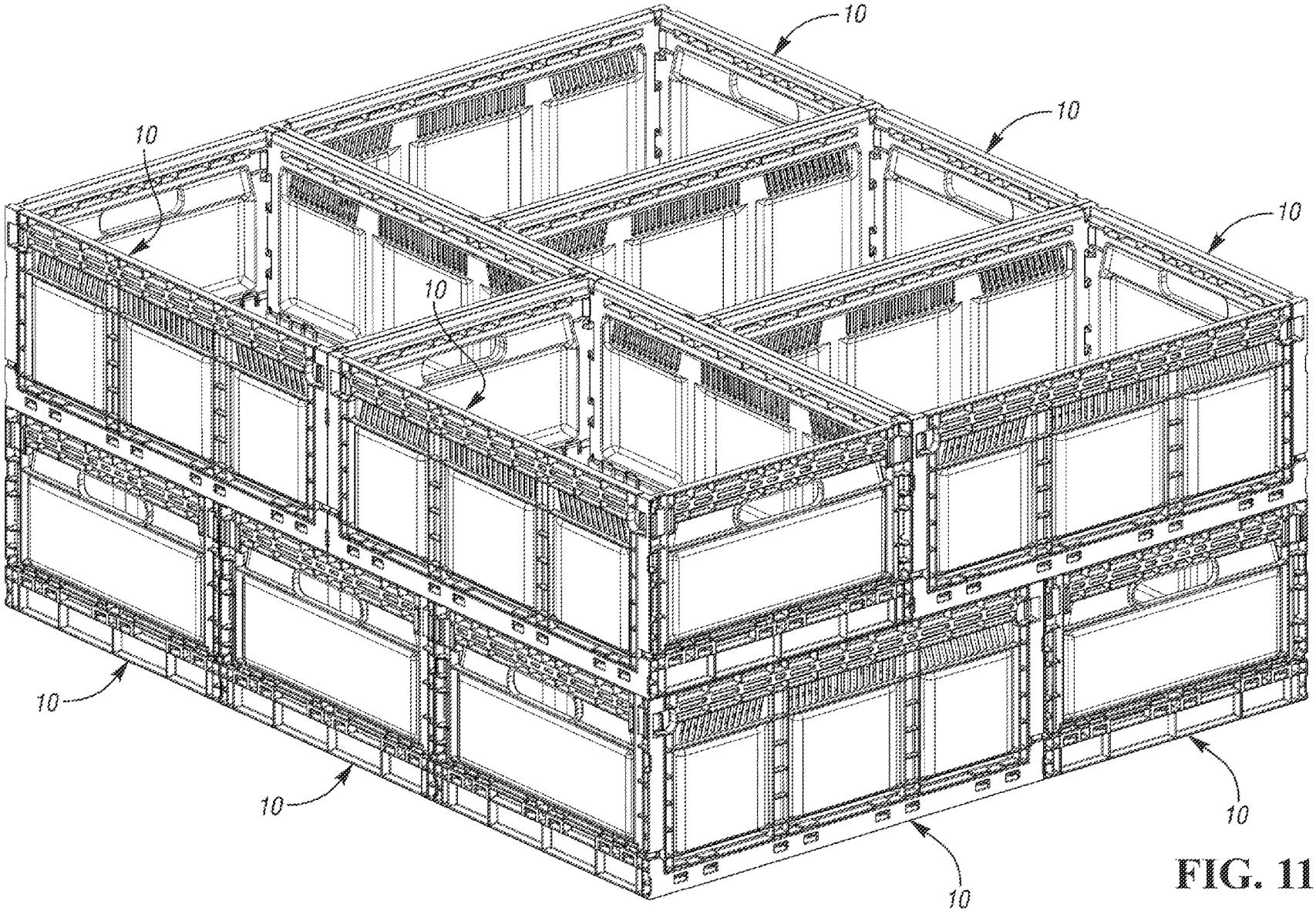
FIG. 11 shows a plurality of the containers of FIG. 1 cross-stacked.

In FIG. 11, a plurality of the containers 10 are cross-stacked, i.e. at least some of the containers 10 in the upper layer are oriented 90 degrees relative to at least some of the containers 10 on which they are stacked.

Figure 12:
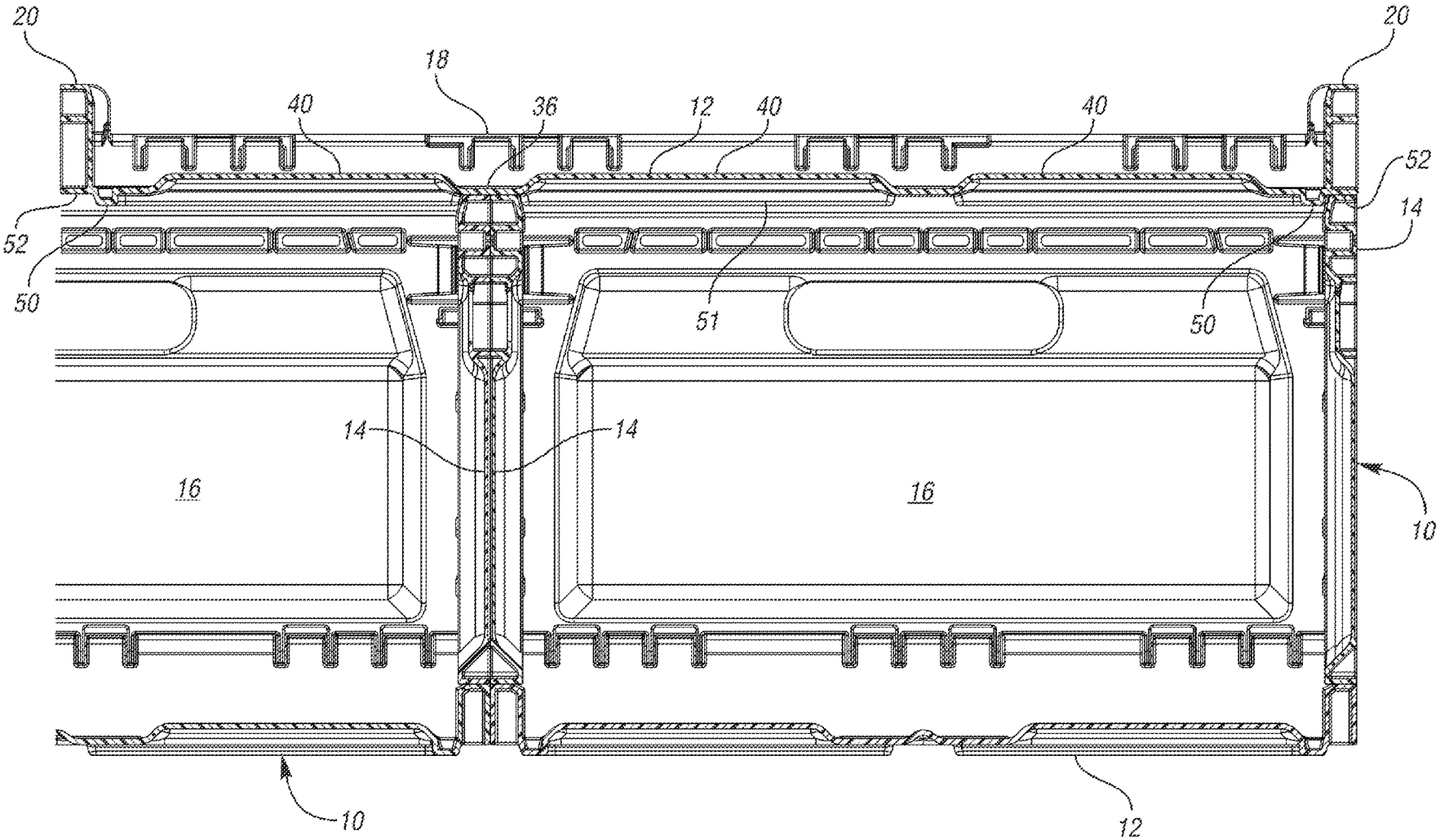
FIG. 12 is a partial section view through the containers of FIG. 11.

FIG. 12 is a section view through a portion of a container 10 cross-stacked on two containers 10. At one end, the peripheral support surface 52 of the upper container 10 is supported on one side wall 14 of the lower container 10. One of the lateral drainage channels 36 of the upper container 10 is aligned with the adjacent side walls 14 of the lower containers 10 to provide support to the heavy loads on the base 12 of the upper container 10. The adjacent side walls 14 of the lower container 10 are also received between the side drag rail 51 and the corner drag rail 50 on each side of the upper container 10.

In use, the container 10 achieves maximum fluid retention. The longitudinal drainage channel 38 and lateral drainage channels 36 will retain fluid in the container 10. The L-shaped troughs 44 and side troughs 46 retain more fluid.

Figure 13:
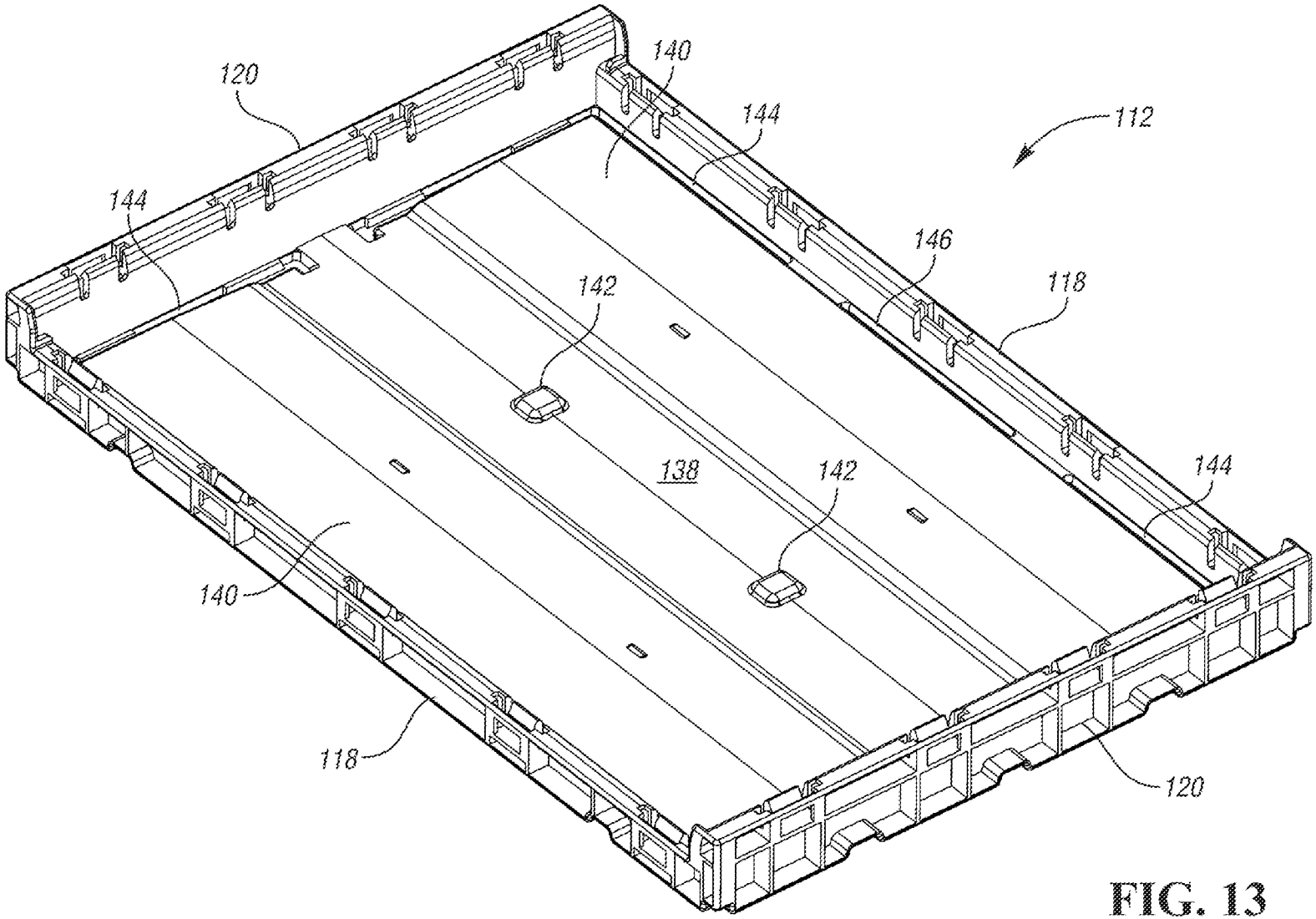
FIG. 13 is an upper perspective view of an alternate base for use in the container of FIG. 1.

FIG. 13 is an upper perspective view of an alternate base 112 for use in the container 10 of FIG. 1. The base 112 includes end flanges 120 taller than side flanges 118. End flanges 120 and side flanges 118 are integrally molded as part of the base 112. The base 112 includes a base wall having a generally planar portion forming a pair of spaced support surfaces 140. The support surfaces 140 are pitched toward a central, longitudinal drainage channel 138 of the base 112 that is lower than the support surfaces 140. A pair of posts 142 protrude upward from the longitudinal drainage channel 138. An L-shaped trough 144 is formed in each corner of the base 112. A side trough 146 is formed along the center of each side edge of the base 112 between the L-shaped troughs 144. The support surfaces 140 are pitched toward the longitudinal drainage channel 138 of the base 112. The troughs 144, 146 are the lowest portions of the base 112 (and form the drag rails on the lower surface of the base 112). Thus any liquids that may leak from contents in the container 110 will drain from the support surfaces 140 toward the longitudinal drainage channel 138 and then toward the troughs 144, 146. This initially keeps the liquids from the support surfaces 140 and posts 142 on which the contents of the container 110 are supported. The base wall of the base 112 does not include openings and thus will retain liquids therein until hinge openings through the flanges 118, 120 are reached (or again, optional slots are reached).

Figure 14:
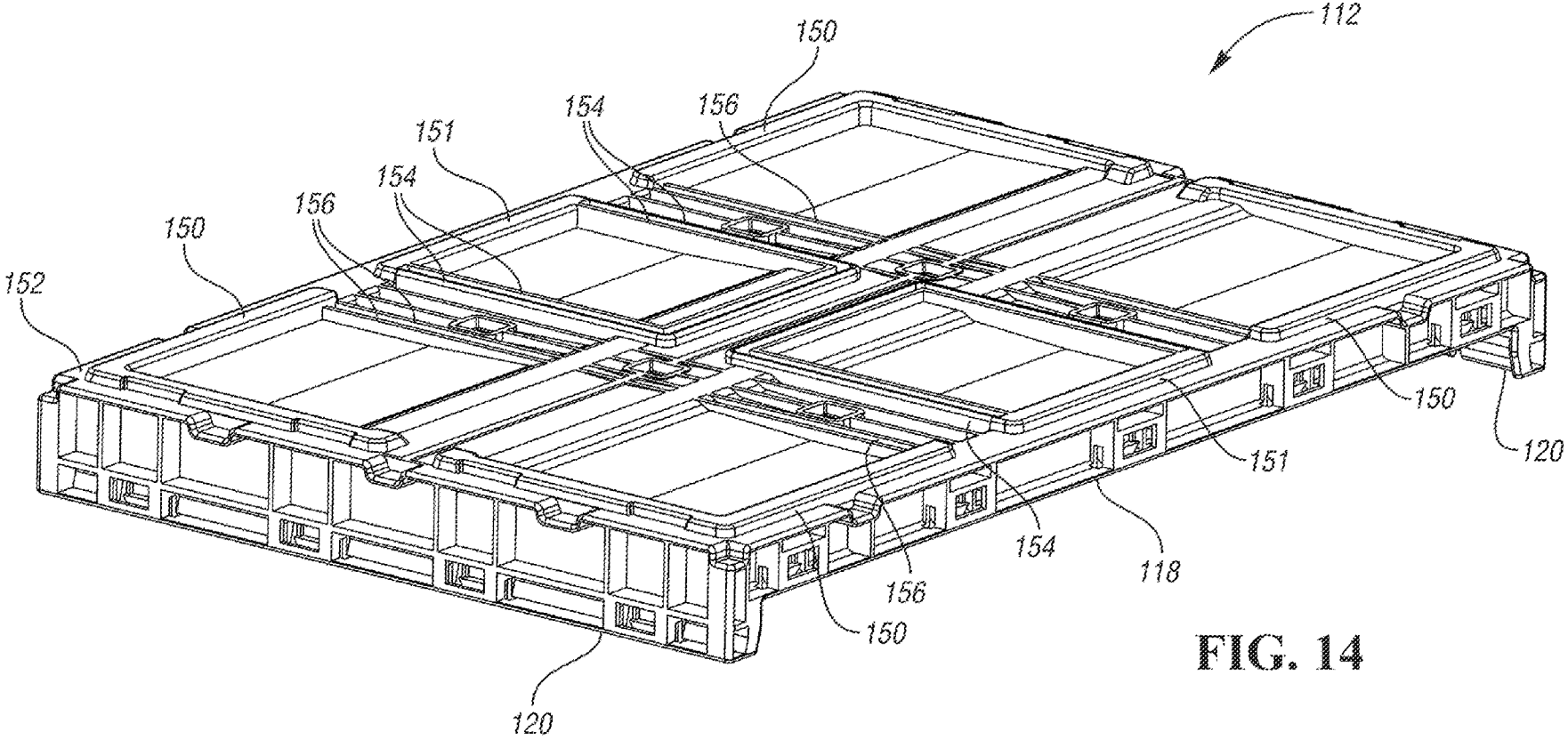
FIG. 14 is a bottom perspective view of the base of FIG. 13.

FIG. 14 is a bottom perspective view of the base 112. A corner drag rail 150 is formed in each corner (by L-shaped troughs 144, FIG. 13) at the periphery of the base 112 but is spaced inward of the periphery of the base 112 to leave a peripheral support surface 152. Side drag rails 151 are formed along side edges of the base 112, but inward of the peripheral support surface 152. In this embodiment, although the upper surface of the base wall has only smooth edges, the bottom of the base 112 includes a plurality of ribs for support, including a plurality of ribs 154, the lower surfaces of which may be coplanar with bottom surfaces of the drag rails 150, 151. Additional ribs 156 maybe provided that do not extend downward as far as the drag rails 150, 151.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base having a plurality of support surfaces separated by drainage channels lower than the support surfaces;

a plurality of troughs proximate edges of the base including L-shaped troughs in corners of the base and side troughs along side edges of the base between the L-shaped troughs and spaced away from the L-shaped troughs, wherein the plurality of troughs are lower than the drainage channels, wherein the plurality of troughs form drag rails on a bottom surface of the base including L-shaped drag rails formed by the L-shaped troughs and side drag rails along side edges of the base between the L-shaped drag rails and spaced away from the L-shaped drag rails, wherein the drag rails provide the lowermost surfaces of the container;

a pair of side walls extending upward from side edges of the base; and a pair of end walls extending upward from end edges of the base.

2. The collapsible container of claim 1 wherein the base includes a base wall and a pair of upstanding side flanges extending upward from side edges of the base wall and a pair of upstanding end flanges extending upward from end edges of the base wall, the side flanges and end flanges formed integrally with the base wall, the pair of side walls pivotably connected to the side flanges, the end walls pivotably connected to the end flanges.

3. The collapsible container of claim 2 further including a plurality of ridges protruding upward from one of the drainage channels.

4. The collapsible container of claim 3 wherein the pair of side walls are pivotable between an upright position generally perpendicular to the base and a collapsed position on the base, wherein in the collapsed position an upper portion of one of the pair of side walls is received in the one of the drainage channels.

5. The collapsible container of claim 4 wherein the drainage channels include a longitudinal drainage channel generally parallel to the side walls and a plurality of lateral drainage channels parallel to the end walls, the plurality of lateral drainage channels intersecting the longitudinal drainage channel to define the plurality of support surfaces.

6. The collapsible container of claim 1 wherein the drainage channels include a longitudinal drainage channel generally parallel to the side walls and a plurality of lateral drainage channels parallel to the end walls, the plurality of lateral drainage channels intersecting the longitudinal drainage channel to define the plurality of support surfaces as a pair of arrays of rectangular support surfaces.

7. The collapsible container of claim 6 wherein the lateral drainage channels and longitudinal drainage channel do not have any openings through the base.

8. The collapsible container of claim 1 wherein the plurality of troughs and plurality of drainage channels do not have any openings through the base.

9. A collapsible container comprising:

a base having opposed side edges and opposed end edges;

a pair of side walls extending upward from side edges of the base; and a pair of end walls extending upward from end edges of the base, the base including a base wall having a plurality of support surfaces separated by a longitudinal drainage channel lower than the support surfaces, wherein the longitudinal drainage channel is generally parallel to the side walls and extends from one end edge of the base to the other end edge of the base, the base further including a plurality of lateral drainage channels parallel to the end walls extending from one side edge of the base to the other side edge of the base, the plurality of lateral drainage channels intersecting the longitudinal drainage channel to define the plurality of support surfaces in two arrays, wherein the base wall does not include any openings therethrough.

10. The collapsible container of claim 9 further including a plurality of troughs proximate edges of the base, wherein the plurality of troughs are lower than the longitudinal drainage channel.

11. The collapsible container of claim 10 wherein the plurality of troughs form drag rails on a bottom surface of the base, wherein the drag rails provide the lowermost surfaces of the container.

12. The collapsible container of claim 11 wherein the plurality of troughs include L-shaped troughs in corners of the base, wherein the drag rails include L-shaped drag rails, the L-shaped troughs forming the L-shaped drag rails.

13. The collapsible container of claim 12 wherein the plurality of troughs include side troughs along side edges of the base between the L-shaped troughs and spaced away from the L-shaped troughs, wherein the drag rails include side drag rails along side edges of the base between the L-shaped drag rails and spaced away from the L-shaped drag rails.

14. The collapsible container of claim 9 further including a plurality of ridges protruding upward from the longitudinal drainage channel.

15. The collapsible container of claim 9 wherein the pair of side walls are pivotable between an upright position generally perpendicular to the base and a collapsed position on the base, wherein in the collapsed position an upper portion of one of the pair of side walls is received in the longitudinal drainage channel.

16. The collapsible container of claim 15 wherein the base further includes a pair of upstanding side flanges extending upward from side edges of the base wall and a pair of upstanding end flanges extending upward from end edges of the base wall, the side flanges and end flanges formed integrally with the base wall, the pair of side walls pivotably connected to the side flanges, the end walls pivotably connected to the end flanges.

17. The collapsible container of claim 9 wherein the lateral drainage channels and longitudinal drainage channel do not have any openings through the base.

18. A container comprising:

a base having a plurality of support surfaces separated by drainage channels lower than the support surfaces;

a plurality of troughs proximate edges of the base including L-shaped troughs in corners of the base and side troughs along side edges of the base between the L-shaped troughs and spaced away from the L-shaped troughs, wherein the plurality of troughs are lower than the drainage channels, wherein the plurality of troughs form drag rails on a bottom surface of the base including L-shaped drag rails formed by the L-shaped troughs and side drag rails along side edges of the base between the L-shaped drag rails and spaced away from the L-shaped drag rails, wherein the drag rails provide the lowermost surfaces of the container;

a pair of side walls extending upward from side edges of the base; and a pair of end walls extending upward from end edges of the base.

19. The container of claim 18 wherein the drainage channels include a longitudinal drainage channel generally parallel to the side walls and a plurality of lateral drainage channels parallel to the end walls, the plurality of lateral drainage channels intersecting the longitudinal drainage channel to define the plurality of support surfaces.

* * * * *